US010578000B2

(12) United States Patent
Kohashi

(10) Patent No.: US 10,578,000 B2
(45) Date of Patent: Mar. 3, 2020

(54) EXHAUST STRUCTURE FOR INTERNAL COMBUSTION ENGINE

(71) Applicant: Toyota Jidosha Kabushiki Kaisha, Toyota-shi, Aichi-ken (JP)

(72) Inventor: Kenichi Kohashi, Sunto-gun Shizuoka-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 179 days.

(21) Appl. No.: 15/695,336

(22) Filed: Sep. 5, 2017

(65) Prior Publication Data

US 2018/0066562 A1 Mar. 8, 2018

(30) Foreign Application Priority Data

Sep. 8, 2016 (JP) ..... 2016-175583

(51) Int. Cl.
*F01N 13/14* (2010.01)

(52) U.S. Cl.
CPC ..... *F01N 13/141* (2013.01); *F01N 13/146* (2013.01); *F01N 2470/24* (2013.01); *F01N 2510/02* (2013.01)

(58) Field of Classification Search
CPC .... F01N 13/141; F01N 13/143; F01N 13/146; F01N 2470/24; F01N 2510/02
See application file for complete search history.

(56) References Cited

U.S. PATENT DOCUMENTS 5,606,857 A * 3/1997 Harada ..... F01N 13/08 60/322
6,519,936 B2 * 2/2003 Smatloch ..... F01N 3/0814 60/297
2009/0269567 A1 * 10/2009 McCabe ..... C23C 28/321 428/220
2009/0277526 A1 * 11/2009 Merry ..... F01N 13/141 138/149
2010/0269939 A1 * 10/2010 Ito ..... C23C 24/00 138/38
2011/0088805 A1 * 4/2011 Nakagawa ..... F01N 13/14 138/140

(Continued)

FOREIGN PATENT DOCUMENTS

CN 201650428 U * 11/2010
JP 03-041046 Y2 8/1991
JP H06101468 A 4/1994

*Primary Examiner* — Audrey K Bradley
(74) *Attorney, Agent, or Firm* — Dinsmore & Shohl LLP

(57) ABSTRACT

An exhaust structure for an internal combustion engine has an exhaust pipe having an inner pipe through which exhaust gas of the internal combustion engine circulates, and an outer pipe covering an outer periphery of the inner pipe, and in the exhaust pipe, an inner radiation layer provided on an outer surface of the inner pipe and having a higher emissivity than the inner pipe, an outer radiation layer provided on an inner surface of the outer pipe and having a higher emissivity than the outer pipe, and an intermediate layer proposed between the inner radiation layer and the outer radiation layer, configured to pass infrared radiation therethrough, and having a lower coefficient of thermal conductivity than the inner pipe and the outer pipe are provided.

13 Claims, 6 Drawing Sheets

(56) References Cited

U.S. PATENT DOCUMENTS

| | | | | |
|---|---|---|---|---|
| 2012/0186238 | A1* | 7/2012 | Akamine | B01D 53/945 60/299 |
| 2016/0053645 | A1* | 2/2016 | Sandou | F01N 3/2066 60/301 |
| 2017/0211447 | A1* | 7/2017 | Wang | F01N 3/20 |

* cited by examiner

EXHAUST STRUCTURE FOR INTERNAL COMBUSTION ENGINE

CROSS-REFERENCE TO RELATED APPLICATIONS

This application claims priority to Japanese Patent Application No. 2016-175583 filed on Sep. 8, 2016, which is incorporated herein by reference in its entirety including the specification, drawings and abstract.

BACKGROUND

1. Technical Field

The technical field of disclosure relates to an exhaust structure for an internal combustion engine.

2. Description of Related Art

As an exhaust structure for an internal combustion engine, there has been known an exhaust structure including an exhaust pipe having a double-pipe structure including an inner pipe, an outer pipe covering the inner pipe, and an atmospheric layer placed between an outer surface of the inner pipe and an inner surface of the outer pipe. As for the exhaust pipe, there has been proposed a structure in which an emissivity of infrared energy of the inner surface of the outer pipe is set higher than an emissivity of the infrared energy of the outer surface of the inner pipe (see Japanese Patent Application Publication No. 06-101468 (JP 06-101468 A), for example).

SUMMARY

In the meantime, in the above exhaust structure for the internal combustion engine, when an exhaust temperature is high such as when the internal combustion engine is operated at a high load, an amount of heat energy thermally radiated from the inner pipe to the outer pipe decreases, which may decrease heat energy dissipated from exhaust gas to the exhaust pipe. As a result, a temperature of the exhaust gas flowing out from the exhaust pipe may increase excessively.

An object of the disclosure is to provide an exhaust structure for an internal combustion engine including an exhaust pipe having a double-pipe structure, the exhaust structure maintaining a temperature of exhaust gas flowing out from an exhaust pipe at an appropriate temperature.

A first aspect of the disclosure relates to an exhaust structure for an internal combustion engine, the exhaust structure including an exhaust pipe of a double-pipe structure including an inner pipe through which exhaust gas of the internal combustion engine flows, and an outer pipe covering an outer periphery of the inner pipe. The exhaust pipe includes: an inner radiation layer provided on an outer surface of the inner pipe and having a higher emissivity of an infrared energy than the inner pipe; an outer radiation layer provided on an inner surface of the outer pipe and having a higher emissivity of the infrared energy than the outer pipe; and an intermediate layer placed between the inner radiation layer and the outer radiation layer, configured to pass infrared radiation through the intermediate layer, and having a lower coefficient of thermal conductivity than the inner pipe and the outer pipe.

With the exhaust structure for the internal combustion engine, configured as such, it is possible to restrain heat energy from coming and going between the inner pipe and the outer pipe due to heat conduction, and by appropriately using the coming and going of the heat energy between the inner pipe and the outer pipe due to thermal radiation, it is possible to maintain, at an appropriate temperature, a temperature of the exhaust gas flowing out from the exhaust pipe.

In the exhaust structure for the internal combustion engine, according to one aspect of the present disclosure, a flange on an exhaust-pipe side may be attached to an upstream end of the outer pipe. The upstream end of the inner pipe may be provided with a guide having a shape which prevents the exhaust gas flowing out from an upstream exhaust system component from flowing into the intermediate layer, which guides the exhaust gas to flow into the inner pipe, and which does not make contact with the outer pipe. With such a configuration, it is possible to restrain the exhaust gas flowing out from an exhaust outlet of the upstream exhaust system component from flowing into the intermediate layer, and it is also possible to restrain thermal conduction from the inner pipe to the flange. Accordingly, when the temperature of the exhaust pipe is low like a warm-up operation of the internal combustion engine, it is possible to restrain a temperature decrease of the exhaust gas flowing through the inner pipe.

The exhaust structure for the internal combustion engine, according to one aspect of the disclosure, may further include a support member placed in a part of the intermediate layer. The support member is a tubular member having an inner peripheral surface making contact with an outer surface of the inner radiation layer, and an outer peripheral surface making contact with an inner surface of the outer radiation layer. Further, the intermediate layer (42) may be a vacuum layer or an atmospheric layer. The inner radiation layer may be a ceramic black paint, and the outer radiation layer may be a ceramic black paint.

With the above aspect of the disclosure, it is possible to maintain, at an appropriate temperature, a temperature of the exhaust gas flowing out from the exhaust pipe in the exhaust structure for the internal combustion engine, the exhaust structure including the exhaust pipe having a double-pipe structure.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

The following describes a specific embodiment of the present disclosure with reference to drawings. A dimension, a material, a shape, a relative arrangement, and the like of a component part described in the present embodiment are not intended to limit a technical scope of the disclosure only to them, unless otherwise designated.

Figure 1:
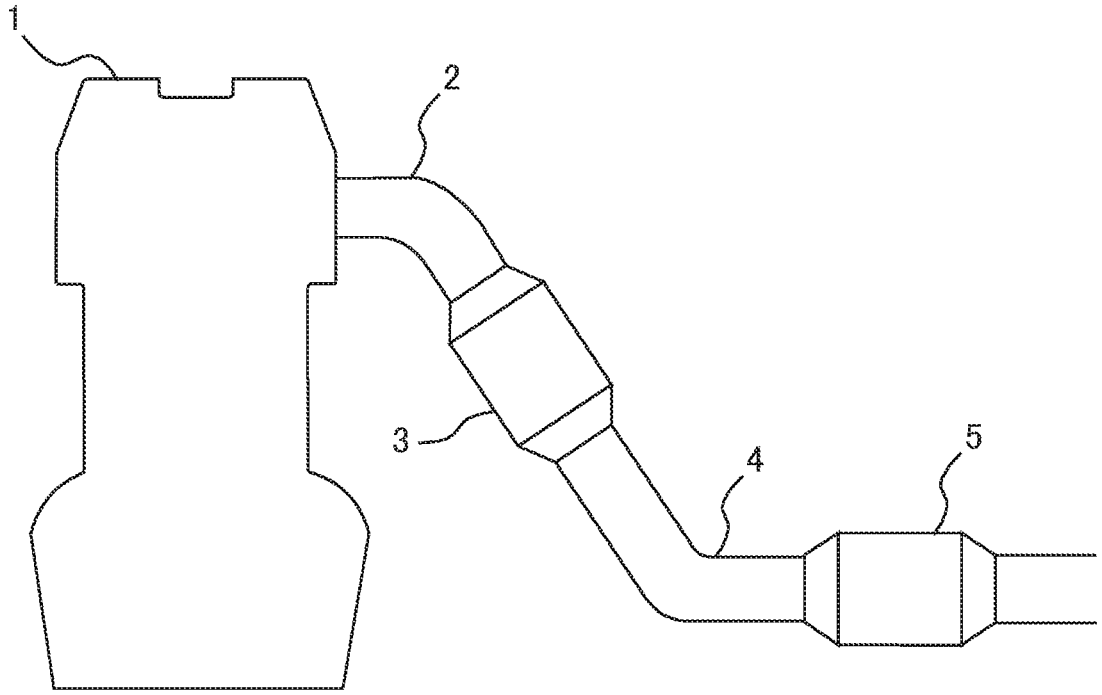
FIG. 1 is a view illustrating a schematic configuration of an exhaust system of an internal combustion engine.

FIG. 1 is a view illustrating a schematic configuration of an exhaust system of an internal combustion engine. The internal combustion engine 1 illustrated in FIG. 1 is a spark-ignition or compression-ignition internal combustion engine including a plurality of cylinders. The internal combustion engine 1 is connected to an upstream end of an exhaust manifold 2. A downstream end of the exhaust manifold 2 is connected to an exhaust inlet of a first catalyst casing 3. An exhaust outlet of the first catalyst casing 3 is connected to an upstream end of the exhaust pipe 4. A downstream end of the exhaust pipe 4 is connected to an exhaust inlet of a second catalyst casing 5.

Figure 2:
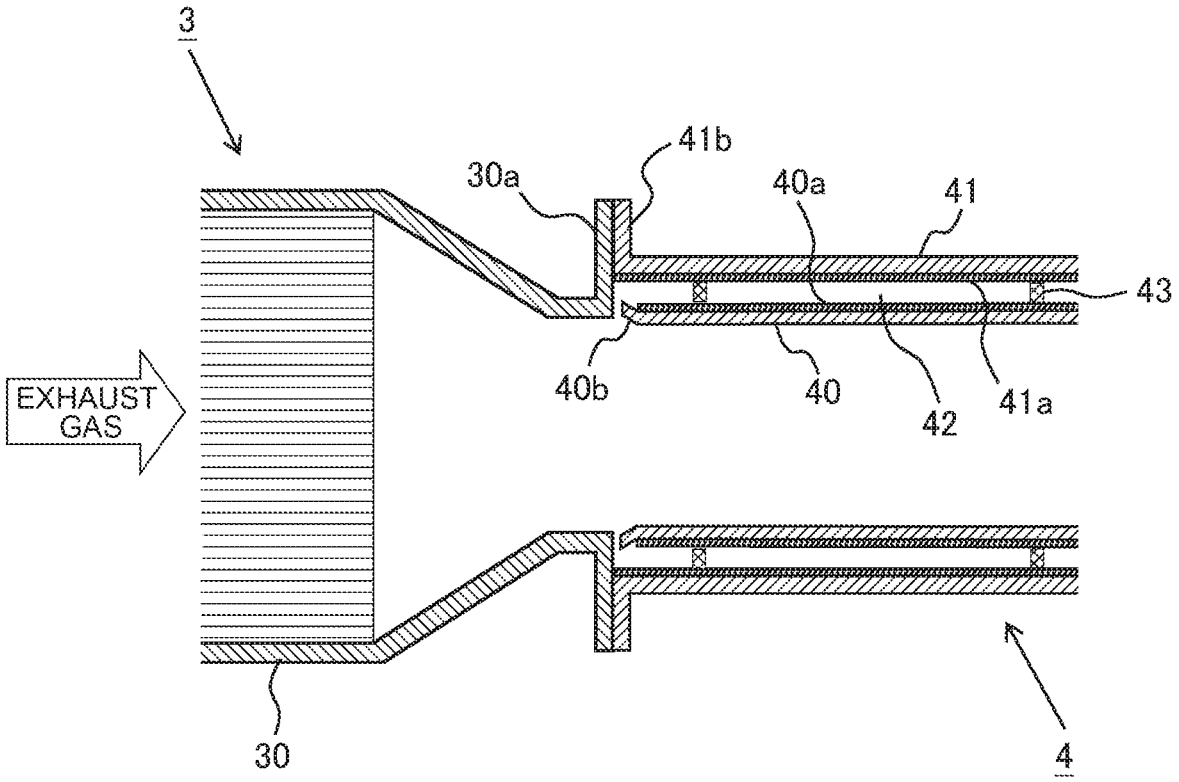
FIG. 2 is a drawing of a longitudinal section, illustrating a configuration of an exhaust pipe.

Here, a configuration of the exhaust pipe 4 in the present embodiment is described with reference to FIG. 2. FIG. 2 is a drawing of a longitudinal section of a connection portion between the first catalyst casing 3 and the exhaust pipe 4. As illustrated in FIG. 2, the exhaust pipe 4 is a cylindrical member including a cylindrical inner pipe 40, an outer pipe 41, which is a cylindrical member having an inside diameter larger than an outside diameter of the inner pipe 40 and which covers an outer periphery of the inner pipe 40, an intermediate layer 42, which is a tubular gap placed between an outer peripheral surface of the inner pipe 40 and an inner peripheral surface of the outer pipe 41, and a support member 43, which is an annular member placed in a part of the intermediate layer 42 and which supports the inner pipe 40 coaxially with the outer pipe 41.

The inner pipe 40 and the outer pipe 41 are made of alloy steel (e.g., a stainless steel sheet or the like) having a relatively low coefficient of thermal conductivity and a high corrosion resistance. The intermediate layer 42 is configured to have a lower coefficient of thermal conductivity than the inner pipe 40 and the outer pipe 41 and to pass infrared light therethrough. In some embodiments, a vacuum layer and an atmospheric layer may be used as the intermediate layer 42. The present embodiment uses an atmospheric layer. Further, the support member 43 is a member having a high heat insulating property and is made of ceramic fiber such as alumina fiber, for example.

An inner radiation layer 40*a* having a higher emissivity than the inner pipe 40 is provided on an outer surface of the inner pipe 40. Further, an outer radiation layer 41*a* having a higher emissivity than the outer pipe 41 is provided on an inner surface of the outer pipe 41. The inner radiation layer 40*a* and the outer radiation layer 41*a* are formed, for example, such that a black paint having a higher emissivity than the inner pipe 40 and the outer pipe 41 is applied on the outer surface of the inner pipe 40 and the inner surface of the outer pipe 41. At this time, as the black paint, a black paint of ceramic having a lower coefficient of thermal conductivity than the inner pipe 40 and the outer pipe 41 may be used.

Further, the exhaust pipe 4 is connected to the first catalyst casing 3 via a flange joint. A flange 30*a* formed in a downstream end of a case 30 of the first catalyst casing 3 and a flange 41*b* formed in an upstream end of the outer pipe 41 are connected by fastening means such as bolts. Further, an upstream end of the inner pipe 40 is provided with a guide 40*b* configured to prevent exhaust gas flowing out from the exhaust outlet of the first catalyst casing 3 from flowing into the intermediate layer 42, which is a gap between the inner pipe 40 and the outer pipe 41, and to guide the inflow of the exhaust gas into the inner pipe 40. At this time, the guide 40*b* is configured to have a shape that does not make contact with the outer pipe 41 and the flange 41*b*. For example, as illustrated in FIG. 2, the upstream end of the inner pipe 40 may be formed in a tapered shape that gradually increases in diameter toward an upstream side within a range smaller than the inside diameter of the outer pipe 41. Note that, a shape of the guide 40*b* may be any shape as long as the following condition is satisfied: the guide 40*b* has a function to prevent the exhaust gas flowing out from the exhaust outlet of the first catalyst casing 3 from flowing into the intermediate layer 42, which is a gap between the inner pipe 40 and the outer pipe 41, and to guide the inflow of the exhaust gas into the inner pipe 40, and the guide 40*b* has a shape that does not make contact with the outer pipe 41 and the flange 41*b*.

With the exhaust structure configured as such, it is possible to restrain heat energy from coming and going between the inner pipe 40 and the outer pipe 41 due to thermal conduction, and it is also possible to maintain, at an appropriate temperature, a temperature (hereinafter referred to as an "outflow exhaust temperature") of the exhaust gas flowing out from the exhaust pipe 4 by use of thermal radiation between the inner pipe 40 and the outer pipe 41 appropriately.

For example, in a case where a temperature of the exhaust pipe 4 is low like a warm-up operation immediately after cold start of the internal combustion engine 1, when heat energy of the exhaust gas flowing into the inner pipe 40 is dissipated to the outer pipe 41 via the inner pipe 40, it is concerned that a temperature decrease of the exhaust gas flowing through the inner pipe 40 becomes large. In this case, an outflow exhaust temperature decreases, which might decrease warm-up performance of a device (e.g., a catalyst accommodated in the second catalyst casing 5, a sensor (not shown), and the like) placed on a downstream side relative to the exhaust pipe 4.

However, in the exhaust pipe 4 of the present embodiment, the intermediate layer 42 having a low coefficient of thermal conductivity is placed between the inner pipe 40 and the outer pipe 41, so that heat energy thermally conducted from the exhaust gas flowing through the inner pipe 40 to the outer pipe 41 via the inner pipe 40 is small. At this time, when a black paint having a lower coefficient of thermal conductivity than the inner pipe 40 is used as the inner radiation layer 40*a*, thermal conduction from the inner pipe 40 to the intermediate layer 42 can be made small, so that the heat energy thermally conducted from the exhaust gas flowing through the inner pipe 40 to the outer pipe 41 via the inner pipe 40 can be more surely reduced.

Figure 3:
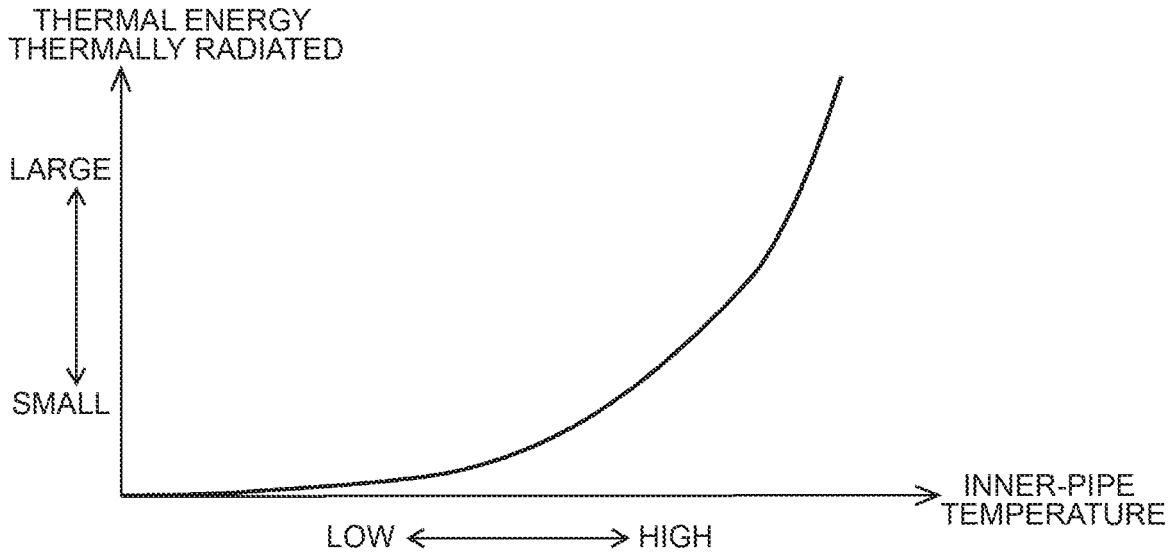
FIG. 3 is a view illustrating a relationship between an inner-pipe temperature and heat energy thermally radiated from the inner pipe to an outer pipe.

In the meantime, since the inner radiation layer 40*a* provided on the outer surface of the inner pipe 40 has a higher emissivity than the inner pipe 40, heat energy of the inner pipe 40 is easily emitted as infrared energy from the inner radiation layer 40*a*. Further, since the intermediate layer 42 of the present embodiment is configured to pass infrared light therethrough, the infrared energy emitted from the inner radiation layer 40*a* easily reaches the outer radiation layer 41*a*. Further, since the outer radiation layer 41*a* provided on the inner surface of the outer pipe 41 has a higher emissivity than the outer pipe 41, the absorptance (infrared energy absorptance) of the outer radiation layer 41*a* is also higher than the outer pipe 41. For those reasons, the infrared energy emitted from the inner radiation layer 40*a* is easily absorbed by the outer pipe 41 via the outer radiation layer 41*a*. Accordingly, the exhaust pipe 4 configured as illustrated in FIG. 2 has such a concern that heat energy thermally radiated from the exhaust gas flowing through the inner pipe 40 to the outer pipe 41 via the inner pipe 40 increases. However, the infrared energy emitted from the inner radiation layer 40*a* is small when a temperature of the inner pipe 40 is low as compared with when the temperature is high. Here, a relationship between the temperature of the inner pipe 40 and the heat energy thermally radiated from the inner pipe 40 to the outer pipe 41 is illustrated in FIG. 3. As illustrated in FIG. 3, the heat energy thermally radiated from the inner pipe 40 to the outer pipe 41 is small when the temperature of the inner pipe 40 is low, and the heat energy increases exponentially as the temperature of the inner pipe 40 increases. Thus, when the temperature of the inner pipe 40 is low such as when the warm-up operation of the internal combustion engine 1, the heat energy thermally radiated from the inner pipe 40 to the outer pipe 41 is small.

Accordingly, in a case where the temperature of the exhaust pipe 4 is low such as when the warm-up operation immediately after the cold start of the internal combustion engine 1, the heat energy thermally conducted from the exhaust gas flowing through the inner pipe 40 to the outer pipe 41 via the inner pipe 40 is small and the heat energy thermally radiated from the exhaust gas to the outer pipe 41 via the inner pipe 40 is also small, thereby making it possible to maintain the heat energy dissipated from the exhaust gas to the exhaust pipe 4 at low. At this time, when an amount of the exhaust gas flowing into the intermediate layer 42 increases in the exhaust gas flowing from the first catalyst casing 3 into the exhaust pipe 4, the heat energy of the exhaust gas is directly transmitted to the outer radiation layer 41*a* and the outer pipe 41, which might increase a temperature decrease amount of the exhaust gas. In this regard, in the exhaust pipe 4 of the present embodiment, the guide 40*b* is provided in the upstream end of the inner pipe 40 as described above, so that the exhaust gas flowing from the first catalyst casing 3 into the exhaust pipe 4 can hardly flow into the intermediate layer 42 and the exhaust gas easily flows into the inner pipe 40. Accordingly, it is possible to maintain, at a low, the amount of the exhaust gas flowing into the intermediate layer 42 out of the exhaust gas flowing from the first catalyst casing 3 into the exhaust pipe 4. Further, when the guide 40*b* of the inner pipe 40 makes contact with the outer pipe 41 and the flange 41*b*, the heat energy of the exhaust gas is thermally conducted to the outer pipe 41 and the flange 41*b* through the inner pipe 40 and the guide 40*b*, which might increase the temperature decrease amount of the exhaust gas. However, since the guide 40*b* of the present embodiment is formed so as not to make contact with the outer pipe 41 and the flange 41*b*, it is possible to restrain the heat energy thermally conducted from the exhaust gas to the outer pipe 41 and the flange 41*b* via the inner pipe 40 and the guide 40*b*. Therefore, when the temperature of the exhaust pipe 4 is low such as when the warm-up operation immediately after the cold start of the internal combustion engine 1, a temperature decrease of the exhaust gas flowing through the inner pipe 40 can be more surely restrained to be small. As a result, a temperature of the exhaust gas flowing out from the exhaust pipe 4 is maintained at a relatively high temperature, so that it is possible to increase the warm-up performance of the device placed on the downstream side relative to the exhaust pipe 4.

Subsequently, when the temperature of the exhaust gas flowing into the inner pipe 40 reaches a high temperature in a state where the temperature of the exhaust pipe 4 is high to some extent like a case where the internal combustion engine 1 is operated at a high load (e.g., acceleration) after the warm-up of the internal combustion engine 1, the heat energy of the exhaust gas is transmitted to the inner pipe 40, so that the temperature of the exhaust gas decreases. Note that, when the intermediate layer 42 is provided between the inner pipe 40 and the outer pipe 41, thermal conduction from the inner pipe 40 to the outer pipe 41 is restrained, so that the heat energy thermally conducted from the exhaust gas flowing through the inner pipe 40 to the outer pipe 41 via the inner pipe 40 becomes small. When the heat energy thermally conducted from the exhaust gas flowing through the inner pipe 40 to the outer pipe via the inner pipe 40 becomes small, it is concerned that a temperature decrease of the exhaust gas flowing through the inner pipe 40 becomes small. In this case, the outflow exhaust temperature is high, so that the temperature of the device placed on the downstream side relative to the exhaust pipe 4 might become excessively high.

However, with the exhaust pipe 4 of the present embodiment, as described in terms of FIG. 3, when the temperature of the inner pipe 40 reaches a high temperature, the heat energy thermally radiated from the inner pipe 40 to the outer pipe 41 via the inner radiation layer 40*a* and the outer radiation layer 41*a* is high. That is, as the temperature of the inner radiation layer 40*a* increases, the infrared energy emitted from the inner radiation layer 40*a* increases, and as the temperature of the outer radiation layer 41*a* increases, the infrared energy absorbed by the outer radiation layer 41*a* increases.

Accordingly, when the temperature of the exhaust gas flowing into the exhaust pipe 4 increases in a state where the temperature of the exhaust pipe 4 is high to some extent, such as when the internal combustion engine operates at high load after the warm-up of the internal combustion engine 1, the thermal radiation from the inner pipe 40 to the outer pipe 41 can be used effectively, so it is possible to increase the heat energy dissipated from the exhaust gas flowing through the inner pipe 40 to the outer pipe 41 via the inner pipe 40. As a result, it is possible to increase the temperature decrease of the exhaust gas flowing through the inner pipe 40.

Figure 4:
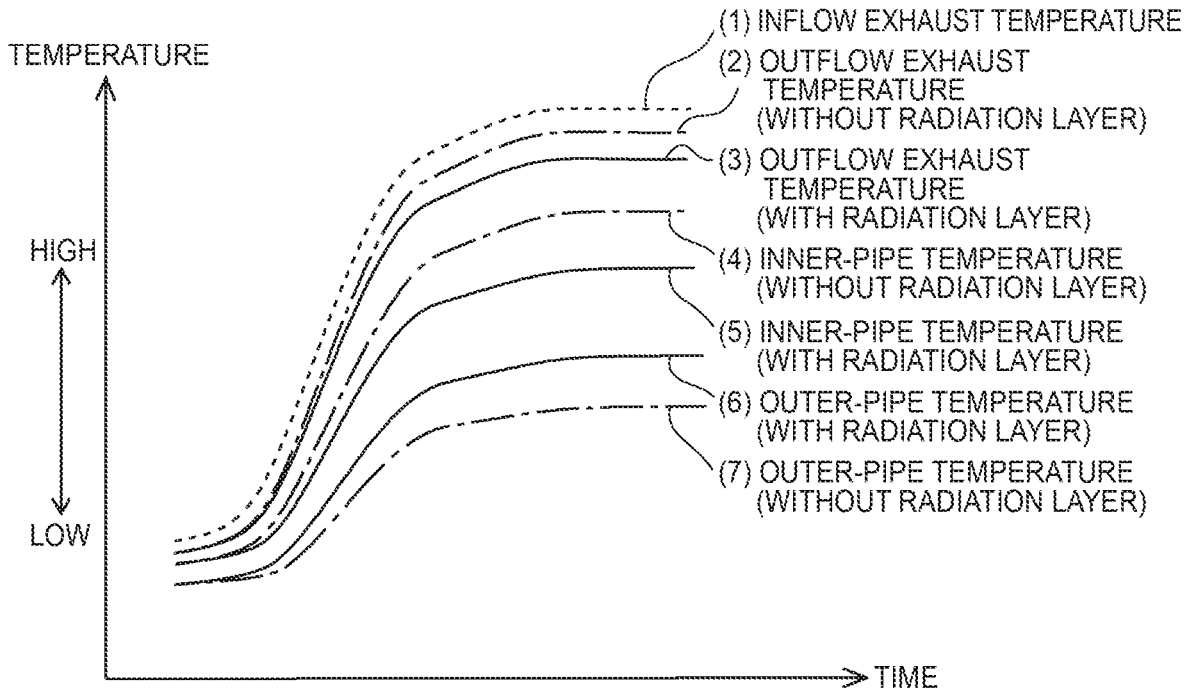
FIG. 4 is a view illustrating changes with time of an inflow exhaust temperature, an outflow exhaust temperature, an inner-pipe temperature, and an outer-pipe temperature in a case where the internal combustion engine is accelerated after the internal combustion engine has been warmed up.

Here, FIG. 4 illustrates changes with time of a temperature (hereinafter referred to as the "inflow exhaust temperature") of the exhaust gas flowing into the exhaust pipe 4, an outflow exhaust temperature, a temperature (an inner-pipe temperature) of the inner pipe 40, and a temperature (an outer-pipe temperature) of the outer pipe 41 in a case where the internal combustion engine 1 is accelerated after the warm-up of the internal combustion engine 1. A broken line (1) in FIG. 4 indicates an inflow exhaust temperature. Three continuous lines (3), (5), (6) in FIG. 4 indicate an outflow exhaust temperature, an inner-pipe temperature, and an outer-pipe temperature, respectively, in a case where the inner radiation layer 40*a* and the outer radiation layer 41*a* are provided. Further, three alternate long and short dash lines (2), (4), (7) in FIG. 4 indicate an outflow exhaust temperature, an inner-pipe temperature, and an outer-pipe temperature, respectively, in a case where the inner radiation layer 40*a* and the outer radiation layer 41*a* are not provided.

Note that the temperatures of (2) to (7) in FIG. 4 are temperatures under the same operating condition.

As illustrated in FIG. 4, the inner-pipe temperature (5) in the case where the inner radiation layer 40*a* and the outer radiation layer 41*a* are provided is lower than the inner-pipe temperature (4) in the case where the inner radiation layer 40*a* and the outer radiation layer 41*a* are not provided. In this regard, the outer-pipe temperature (6) in the case where the inner radiation layer 40*a* and the outer radiation layer 41*a* are provided is higher than the outer-pipe temperature (7) in the case where the inner radiation layer 40*a* and the outer radiation layer 41*a* are not provided. That is, as compared with the case where the inner radiation layer 40*a* and the outer radiation layer 41*a* are not provided, in the case where the inner radiation layer 40*a* and the outer radiation layer 41*a* are provided, heat energy thermally radiated from the inner pipe 40 to the outer pipe 41 is large due to the effect of the inner radiation layer 40*a* and the outer radiation layer 41*a*. As a result, the outflow exhaust temperature (3) in the case where the inner radiation layer 40*a* and the outer radiation layer 41*a* are provided is lower than the outflow exhaust temperature (2) in the case where the inner radiation layer 40*a* and the outer radiation layer 41*a* are not provided.

Accordingly, with the exhaust structure of the present embodiment, when the outflow exhaust temperature increases in a state where the temperature of the exhaust pipe 4 is high to some extent such as when the high-load operation after the warm-up of the internal combustion engine 1, it is possible to increase the temperature decrease of the exhaust gas flowing through the exhaust pipe 4. As a result, the outflow exhaust temperature becomes low, thereby making it possible to restrain the temperature of the device placed on the downstream side relative to the exhaust pipe 4 from increasing excessively.

Subsequently, when the inflow exhaust temperature shifts from a high-temperature state to a low-temperature state in a state where the temperature of the exhaust pipe 4 increases such as when the internal combustion engine 1 shifts from a high-load operation state to a deceleration fuel cut-off state after the warm-up of the internal combustion engine 1, the temperature of the exhaust gas flowing into the inner pipe 40 decreases rapidly, so that the heat energy of the inner pipe 40 is transmitted to the exhaust gas. This decreases the temperature of the inner pipe 40. In a course where the temperature of the inner pipe 40 decreases, when the temperature of the inner pipe 40 becomes lower than the temperature of the outer pipe 41, heat energy of the outer pipe 41 is thermally conducted to the inner pipe 40 via the intermediate layer 42. However, the coefficient of thermal conductivity of the intermediate layer 42 is small, so the heat energy thermally conducted from the outer pipe 41 to the inner pipe 40 decreases.

However, with the exhaust pipe 4 of the present embodiment, the heat energy of the outer pipe 41 is easily emitted as infrared energy from the outer radiation layer 41*a*, and the infrared energy thus emitted from the outer radiation layer 41*a* is easily absorbed by the inner pipe 40 via the inner radiation layer 40*a*. Accordingly, in a case where the internal combustion engine 1 shifts from the high load operation state to the deceleration fuel cut-off state, when the temperature of the inner pipe 40 becomes lower than the temperature of the outer pipe 41, the thermal radiation from the outer pipe 41 to the inner pipe 40 can be used effectively, so that the heat energy dissipated from the outer pipe 41 to the inner pipe 40 increases. Along with this, the heat energy transmitted from the inner pipe 40 to the exhaust gas flowing through the inner pipe 40 also increases.

Figure 5:
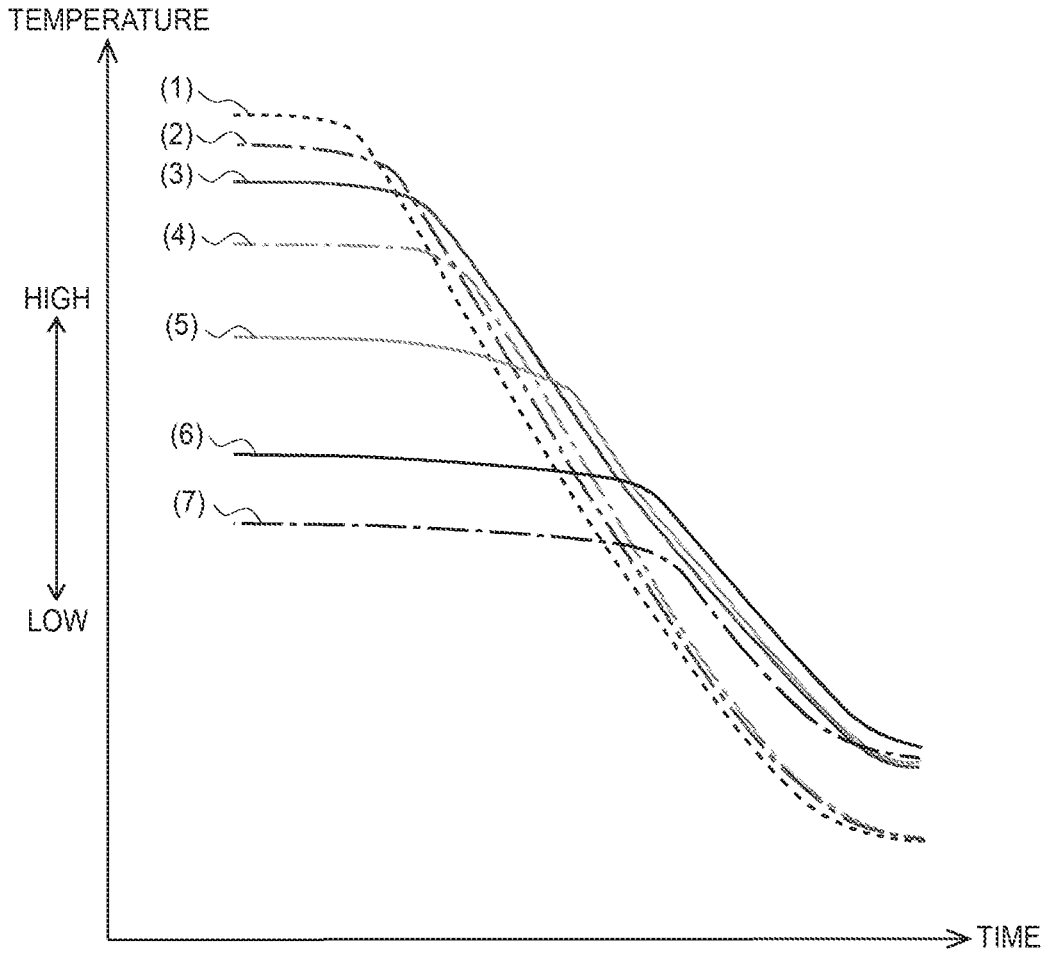
FIG. 5 is a view illustrating changes with time of an inflow exhaust temperature, an outflow exhaust temperature, an inner-pipe temperature, and an outer-pipe temperature in a case where the internal combustion engine shifts from a high-load operation state to a deceleration fuel cut-off state after the internal combustion engine has been warmed up.

Here, FIG. 5 illustrates changes with time of an inflow exhaust temperature, an outflow exhaust temperature, an inner-pipe temperature, and an outer-pipe temperature in a case where the internal combustion engine 1 shifts from the high-load operation state to the deceleration fuel cut-off state after the warm-up of the internal combustion engine 1. Respective lines of (1) to (7) in FIG. 5 indicate the same temperatures of respective lines of (1) to (7) in FIG. 4 described above.

As illustrated in FIG. 5, immediately after the internal combustion engine 1 has shifted from the high load operation state to the deceleration fuel cut-off state, the inner-pipe temperature (5) in the case where the inner radiation layer 40*a* and the outer radiation layer 41*a* are provided is lower than the inner-pipe temperature (4) in the case where the inner radiation layer 40*a* and the outer radiation layer 41*a* are not provided. Further, immediately the internal combustion engine 1 has shifted from the high load operation state to the deceleration fuel cut-off state, the outer-pipe temperature (6) in the case where the inner radiation layer 40*a* and the outer radiation layer 41*a* are provided is higher than the outer-pipe temperature (7) in the case where the inner radiation layer 40*a* and the outer radiation layer 41*a* are not provided. That is, at the time of the high load operation just before the deceleration fuel cut-off, the heat energy of the exhaust gas flowing through the inner pipe 40 is thermally radiated to the outer pipe 41 via the inner pipe 40, as described in terms of FIG. 4.

Further, some time after the internal combustion engine 1 has shifted to the deceleration fuel cut-off state, the inner-pipe temperature (5) in the case where the inner radiation layer 40*a* and the outer radiation layer 41*a* are provided is maintained at a higher temperature than the inner-pipe temperature (4) in the case where the inner radiation layer 40*a* and the outer radiation layer 41*a* are not provided. Further, some time after the internal combustion engine 1 has shifted to the deceleration fuel cut-off state, the outer-pipe temperature (6) in the case where the inner radiation layer 40*a* and the outer radiation layer 41*a* are provided approaches the outer-pipe temperature (7) in the case where the inner radiation layer 40*a* and the outer radiation layer 41*a* are not provided. That is, in the case where the inner radiation layer 40*a* and the outer radiation layer 41*a* are provided, the heat energy thermally radiated from the outer pipe 41 to the inner pipe 40 increases as compared with the case where the inner radiation layer 40*a* and the outer radiation layer 41*a* are not provided.

As a result, immediately after the internal combustion engine 1 has shifted from the high load operation state to the deceleration fuel cut-off state, the outflow exhaust temperature (3) in the case where the inner radiation layer 40*a* and the outer radiation layer 41*a* are provided is lower than the outflow exhaust temperature (2) in the case where the inner radiation layer 40*a* and the outer radiation layer 41*a* are not provided. However, some time after the internal combustion engine 1 has shifted to the deceleration fuel cut-off state, the outflow exhaust temperature (3) in the case where the inner radiation layer 40*a* and the outer radiation layer 41*a* are provided is maintained at a higher temperature than the outflow exhaust temperature (2) in the case where the inner radiation layer 40*a* and the outer radiation layer 41*a* are not provided.

Accordingly, with the exhaust structure of the present embodiment, when the inflow exhaust temperature shifts from the high-temperature state to the low-temperature state in the state where the temperature of the exhaust pipe 4 increases, such as when the internal combustion engine 1 has shifted from the high-load operation state to the deceleration fuel cut-off state after the warm-up of the internal combustion engine 1, it is possible to increase the temperature decrease of the exhaust gas flowing through the inner pipe 40. As a result, the outflow exhaust temperature becomes high, thereby making it possible to restrain the temperature of the device placed on the downstream side relative to the exhaust pipe 4 from decreasing excessively.

As has been described earlier, with the exhaust structure for the internal combustion engine in the present embodiment, the outflow exhaust temperature can be maintained at an appropriate temperature. As a result, the temperature of the device placed on the downstream side relative to the exhaust pipe 4 can be easily set to a temperature suitable for the operation of the device.

Modification

Figure 6:
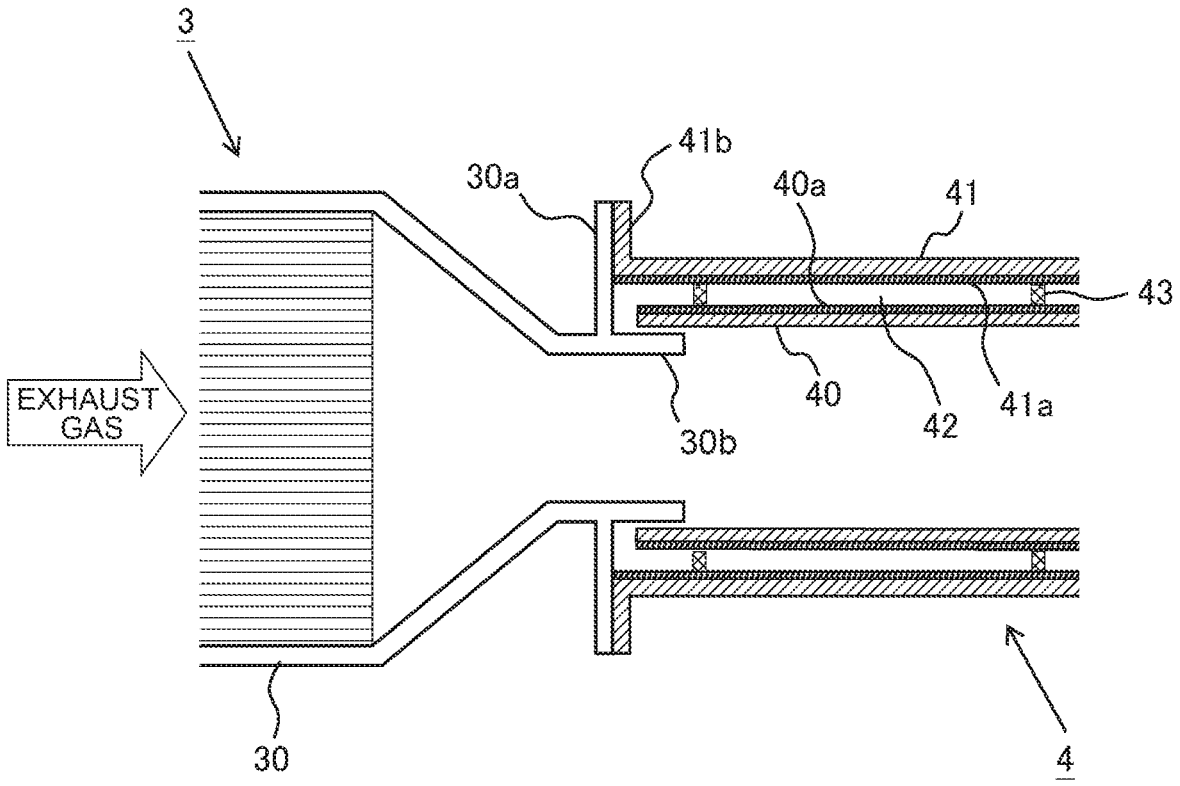
FIG. 6 is a view illustrating a modification of an exhaust structure for the internal combustion engine.

The above embodiment deals with a method in which the guide 40*b* is provided in the upstream end of the inner pipe 40 as a method for restraining the exhaust gas flowing into the exhaust pipe 4 from flowing into the intermediate layer 42, but it is also possible to use a method in which the exhaust outlet of the first catalyst casing 3 is formed so as to be inserted into the inner pipe 40. FIG. 6 is a view illustrating a modification of the exhaust structure for the internal combustion engine. In FIG. 6, an exhaust outlet 30*b* of a case 30 of a first catalyst casing 3 is formed so as to extend toward the downstream side relative to a flange 30*a*. At this time, an exhaust pipe 4 is configured such that an inside diameter of an inner pipe 40 is larger than an outside diameter of the exhaust outlet 30*b*. In a case where the exhaust outlet 30*b* of the first catalyst casing 3 and the exhaust pipe 4 are configured as such, when the first catalyst casing 3 is connected to the exhaust pipe 4 via a flange joint, a downstream end of the exhaust outlet 30*b* is inserted into the downstream side from an upstream end of the inner pipe 40, so that exhaust gas flowing out from the exhaust outlet 30*b* is restrained from flowing into an intermediate layer 42. Further, since the inside diameter of the inner pipe 40 is formed larger than the outside diameter of the exhaust outlet 30*b*, an inner wall of the inner pipe 40 does not make contact with an outer wall of the exhaust outlet 30*b*, so that it is also possible to maintain, at a small, heat energy thermally conducted from the exhaust gas to the flange 30*a* via the inner pipe 40 and the exhaust outlet 30*b* at the time of a warm-up operation or the like of the internal combustion engine 1. Thus, with the modification illustrated in FIG. 6, the operation-effect similar to the above embodiment can be obtained.

A first aspect relates to an exhaust structure for an internal combustion engine, the exhaust structure including an exhaust pipe having a double-pipe structure including an inner pipe through which exhaust gas of the internal combustion engine circulates, and an outer pipe covering an outer periphery of the inner pipe. The exhaust pipe includes an inner radiation layer provided on an outer surface of the inner pipe and having a higher emissivity of an infrared energy than the inner pipe, an outer radiation layer provided on an inner surface of the outer pipe and having a higher emissivity of the infrared energy than the outer pipe, and an intermediate layer placed between the inner radiation layer and the outer radiation layer, configured to pass infrared radiation through the intermediate layer, and having a lower coefficient of thermal conductivity than the inner pipe and the outer pipe.

With the exhaust structure for the internal combustion engine, configured as such, it is possible to restrain heat energy from coming and going between the inner pipe and the outer pipe due to thermal conduction, and by appropriately using the coming and going of the heat energy between the inner pipe and the outer pipe due to thermal radiation, it is possible to maintain, at an appropriate temperature, a temperature of the exhaust gas flowing out from the exhaust pipe.

For example, in a case where the temperature of the exhaust pipe is low such as when an warm-up operation immediately after cold start of the internal combustion engine, when heat energy dissipated to the exhaust pipe from the exhaust gas flowing through the inner pipe, a temperature of the exhaust gas largely decreases. Note that, in the warm-up operation immediately after the cold start of the internal combustion engine, when a temperature decrease of the exhaust gas flowing through the inner pipe increases, the temperature of the exhaust gas flowing out from the exhaust pipe decreases accordingly. This might cause malfunctions such as a decrease in warm-up performance of a device such as an exhaust gas cleaning catalyst or an air-fuel-ratio sensor placed on the downstream side relative to the exhaust pipe.

In this regard, in the exhaust structure in one aspect, the intermediate layer having a lower coefficient of thermal conductivity than the inner pipe and the outer pipe is placed between the inner pipe and the outer pipe, and therefore, thermal conduction from the inner pipe to the outer pipe is restrained. This accordingly reduces heat energy thermally conducted from the exhaust gas flowing through the inner pipe to the outer pipe via the inner pipe.

In the meantime, in a case where the inner radiation layer having a higher emissivity than the inner pipe is provided on the outer surface of the inner pipe, heat energy of the inner pipe is easily emitted as infrared energy in comparison with a case where the inner radiation layer is not provided. Here, the infrared energy thus emitted from the inner pipe passes through the intermediate layer so as to be absorbed by the outer pipe. That is, the heat energy of the inner pipe is transmitted to the outer pipe as the infrared energy. In other words, the heat energy of the inner pipe is transmitted to the outer pipe by thermal radiation. Therefore, in comparison with the case where the inner radiation layer is not provided, in the case where the inner radiation layer is provided on the outer surface of the inner pipe, there is such a concern that the heat energy thermally radiated from the exhaust gas flowing through the inner pipe to the outer pipe via the inner pipe might increase. However, an amount of the infrared energy emitted from the inner radiation layer is small when a temperature of the inner pipe is low as compared with a case where the temperature is high. On that account, when the temperature of the inner pipe is low such as when the internal combustion engine is warmed up, the infrared energy emitted from the inner radiation layer is small. This consequently reduces the heat energy thermally radiated from the exhaust gas flowing through the inner pipe to the outer pipe via the inner pipe.

Accordingly, when the temperature of the exhaust pipe is low like the warm-up operation immediately after the cold start of the internal combustion engine, the heat energy thermally conducted from the exhaust gas flowing through the inner pipe to the outer pipe via the inner pipe is small and the heat energy thermally radiated from the exhaust gas to the outer pipe via the inner pipe is also small. That is, when the temperature of the inner pipe is low such as when the internal combustion engine is warmed up, the heat energy dissipated to the exhaust pipe from the exhaust gas flowing through the inner pipe is small. As a result, it is possible to decrease a temperature decrease of the exhaust gas flowing through the inner pipe. In the warm-up operation immediately after the cold start of the internal combustion engine, when the temperature decrease of the exhaust gas flowing through the inner pipe is small, the temperature of the exhaust gas flowing out from the exhaust pipe is maintained at a relatively high temperature. This makes it possible to increase warm-up performance of a device placed on the downstream side relative to the exhaust pipe.

In the meantime, when the internal combustion engine is operated at a high load in a state where the temperature of the exhaust pipe is high to some extent such as when the internal combustion engine has been warmed up, the temperature of the exhaust gas flowing through the inner pipe increases, so that the temperature of the inner pipe also increases accordingly. Here, when the intermediate layer having a low coefficient of thermal conductivity is placed between the inner pipe and the outer pipe, the heat energy thermally conducted from the exhaust gas flowing through the inner pipe to the outer pipe via the inner pipe is reduced. On this account, it is concerned that a temperature decrease of the exhaust gas flowing through the inner pipe might become small. In that case, the temperature of the exhaust gas flowing out from the exhaust pipe increases, which might causes malfunctions such as an excessive temperature increase of the device placed on the downstream side relative to the exhaust pipe.

In this regard, in the exhaust structure, the inner radiation layer having a higher emissivity than the inner pipe is provided on the outer surface of the inner pipe, and therefore, the heat energy of the inner pipe is easily emitted as infrared energy from the inner radiation layer. Further, the amount of the infrared energy emitted from the inner radiation layer is large when the temperature of the inner pipe is high as compared with a case where the temperature is low, as described above. Accordingly, when the temperature of the inner pipe increases, the amount of the infrared energy emitted from the inner pipe via the inner radiation layer also increases. Further, in a case where the outer radiation layer having a higher emissivity than the outer pipe is provided on the inner surface of the outer pipe, an amount of infrared energy absorbed by the outer pipe via the outer radiation layer, out of the infrared energy emitted from the inner radiation layer, is large in comparison with a case where the outer radiation layer is not provided. This is because, as the emissivity of the outer radiation layer is higher, the absorptance of the infrared energy in the outer radiation layer is also higher. Thus, when the temperature of the inner pipe is high such as when the internal combustion engine operates at a high load after the warm-up of the internal combustion engine, the heat energy thermally radiated from the exhaust gas flowing through the inner pipe to the outer pipe via the inner pipe is large.

Accordingly, when the temperature of the exhaust gas flowing through the inner pipe is high such as when the internal combustion engine operates at the high load after the warm-up of the internal combustion engine, the thermal radiation from the inner pipe to the outer pipe can be used effectively, so that the heat energy dissipated from the exhaust gas to the outer pipe via the inner pipe increases. This makes it possible to increase the temperature decrease of the exhaust gas flowing through the inner pipe. As a result, the temperature of the exhaust gas flowing out from the exhaust pipe decreases, thereby making it possible to restrain an excessive temperature increase of the device placed on the downstream side relative to the exhaust pipe.

Further, when the temperature of the exhaust gas flowing into the inner pipe shifts from a high-temperature state to a low-temperature state such as when the internal combustion engine shifts from a high-load operation state to a deceleration fuel cut-off state, heat energy of the inner pipe is transmitted to the exhaust gas flowing through the inner pipe, thereby decreasing the temperature of the inner pipe and increasing the temperature of the exhaust gas flowing through the inner pipe. However, in a case where the intermediate layer having a low coefficient of thermal conductivity is placed between the inner pipe and the outer pipe, even if the temperature of the inner pipe becomes lower than the temperature of the outer pipe in the course of the decrease of the temperature of the inner piper, heat energy thermally conducted from the outer pipe to the inner pipe is small. Along with this, heat energy transmitted from the outer pipe to the exhaust gas flowing through the inner pipe via the inner pipe decreases, so it is concerned that a temperature increase of the exhaust gas flowing through the inner pipe might be small. As a result, the temperature of the exhaust gas flowing out from the exhaust pipe decreases, which might cause malfunctions such as inactivation of the device placed on the downstream side relative to the exhaust pipe.

In this regard, in the exhaust structure, the inner radiation layer and the outer radiation layer are provided on the outer surface of the inner pipe and on the inner surface of the outer pipe, respectively. Accordingly, when the temperature of the inner pipe becomes lower than the temperature of the outer pipe, heat energy thermally radiated from the outer pipe to the inner pipe increases. When the heat energy thermally radiated from the outer pipe to the inner pipe increases, heat energy transmitted from the inner pipe to the exhaust gas flowing through the inner pipe also increases.

Accordingly, when the temperature of the exhaust gas flowing into the inner pipe shifts from the high-temperature state to the low-temperature state such as when the internal combustion engine shifts from the high-load operation state to the deceleration fuel cut-off state, thermal radiation from the inner pipe to the outer pipe can be used effectively, so that heat energy dissipated from the exhaust pipe to the exhaust gas flowing through the inner pipe via the inner pipe increases. This makes it possible to increase the temperature increase of the exhaust gas flowing through the inner pipe. As a result, the temperature of the exhaust gas flowing out from the exhaust pipe increases, thereby making it possible to restrain inactivation of the device placed on the downstream side relative to the exhaust pipe.

Note that the exhaust pipe may be connected, via a flange joint, to an upstream exhaust system component such as an exhaust manifold or a catalyst casing placed on the upstream side relative to the exhaust pipe. In such a case, when the exhaust gas flowing out from an exhaust outlet of the upstream exhaust system component flows into the intermediate layer, heat energy of the exhaust gas is directly transmitted to the outer radiation layer and the outer pipe at the time when the temperature of the exhaust pipe is low like the warm-up operation of the internal combustion engine, which makes it difficult to effectively restrain the temperature decrease of the exhaust gas. Further, in a case where a flange on an exhaust pipe side is attached to the inner pipe, when the temperature of the exhaust pipe is low like the warm-up operation of the internal combustion engine, heat energy of the exhaust gas is dissipated outside from the inner pipe via the flange, which makes it difficult to effectively restrain the temperature decrease of the exhaust gas.

In the exhaust structure for the internal combustion engine, according to one aspect, the flange on the exhaust pipe side may be attached to an upstream end of the outer pipe. An upstream end of the inner pipe may be provided with a guide having a shape which prevents the exhaust gas flowing out from the upstream exhaust system component from flowing into the intermediate layer, which guides the exhaust gas to flow into the inner pipe, and which does not make contact with the outer pipe. With such a configuration, it is possible to restrain the exhaust gas flowing out from the exhaust outlet of the upstream exhaust system component from flowing into the intermediate layer, and it is also possible to restrain thermal conduction from the inner pipe to the flange. Accordingly, when the temperature of the exhaust pipe is low like the warm-up operation of the internal combustion engine, it is possible to restrain a temperature decrease of the exhaust gas flowing through the inner pipe.

The exhaust structure for the internal combustion engine, according to one aspect, may further include a support member placed in a part of the intermediate layer. The support member is a tubular member having an inner peripheral surface making contact with the outer surface of the inner radiation layer, and an outer peripheral surface making contact with the inner surface of the outer radiation layer. Further, the intermediate layer (42) may be a vacuum layer or an atmospheric layer. The inner radiation layer may be a ceramic black paint, and the outer radiation layer may be a ceramic black paint.

Note that, from the viewpoint of restraining the exhaust gas flowing out from the exhaust outlet of the upstream exhaust system component from flowing into the intermediate layer, a configuration in which the exhaust outlet of the upstream exhaust system component extends into the inner pipe at the time when the upstream exhaust system component is connected to the exhaust pipe (that is, a configuration in which the exhaust outlet of the upstream exhaust system component is inserted into the inner pipe) may be employed.

With the above aspect, it is possible to maintain, at an appropriate temperature, a temperature of the exhaust gas flowing out from the exhaust pipe in the exhaust structure for the internal combustion engine, the exhaust structure including the exhaust pipe having a double-pipe structure.

What is claimed is:

1. An exhaust structure for an internal combustion engine, the exhaust structure comprising:

an exhaust pipe having a double-pipe structure including an inner pipe through which exhaust gas of the internal combustion engine flows, and an outer pipe covering an outer periphery of the inner pipe;

an inner radiation layer provided on an outer surface of the inner pipe and having a higher emissivity of an infrared energy than the inner pipe;

an outer radiation layer provided on an inner surface of the outer pipe and having a higher emissivity of the infrared energy than the outer pipe; and an intermediate layer provided between the inner radiation layer and the outer radiation layer, the intermediate layer configured to pass infrared radiation through the intermediate layer, and the intermediate layer having a lower coefficient of thermal conductivity than the inner pipe and the outer pipe, wherein the intermediate layer is a vacuum layer;

wherein the exhaust pipe is connected, via a flange coupling, to a catalyst casing placed on an upstream side relative to the exhaust pipe; and wherein a first flange formed in a downstream end of the catalyst casing is connected to a second flange formed in an upstream end of the outer pipe.

2. The exhaust structure for the internal combustion engine, according to claim 1, wherein:

an upstream end of the inner pipe is provided with a guide having a shape which prevents the exhaust gas flowing out from the catalyst casing from flowing into the intermediate layer, the guide being configured to guide the exhaust gas to flow into the inner pipe, and the guide being configured not to make contact with the outer pipe.

3. The exhaust structure for the internal combustion engine, according to claim 1, wherein:

the catalyst casing has an extending portion extending into the inner pipe when the catalyst casing and the exhaust pipe are connected to each other.

4. The exhaust structure for the internal combustion engine, according to claim 1, further comprising:

a support member placed in a part of the intermediate layer, the support member being a tubular member having an inner peripheral surface making contact with an outer surface of the inner radiation layer, and an outer peripheral surface making contact with an inner surface of the outer radiation layer.

5. The exhaust structure for the internal combustion engine, according to claim 1, wherein the inner radiation layer is a ceramic black paint; and the outer radiation layer is a ceramic black paint.

6. An exhaust structure for an internal combustion engine, the exhaust structure comprising:

an exhaust pipe having a double-pipe structure including an inner pipe through which exhaust gas of the internal combustion engine flows, and an outer pipe covering an outer periphery of the inner pipe;

an inner radiation layer provided on an outer surface of the inner pipe and having a higher emissivity of an infrared energy than the inner pipe;

an outer radiation layer provided on an inner surface of the outer pipe and having a higher emissivity of the infrared energy than the outer pipe; and an intermediate layer provided between the inner radiation layer and the outer radiation layer, the intermediate layer configured to pass infrared radiation through the intermediate layer, and the intermediate layer having a lower coefficient of thermal conductivity than the inner pipe and the outer pipe, wherein:

the exhaust pipe is connected, via a flange coupling, to a catalyst placed on an upstream side relative to the exhaust pipe;

a first flange on an exhaust-pipe side is attached to an upstream end of the outer pipe;

a second flange formed in a downstream end of a casing for the catalyst is connected to the first flange; and an upstream end of the inner pipe is provided with a guide having a shape which prevents the exhaust gas flowing out from the catalyst from flowing into the intermediate layer, the guide being configured to guide the exhaust gas to flow into the inner pipe, and the guide being configured not to make contact with the outer pipe.

7. The exhaust structure for the internal combustion engine, according to claim 6, further comprising:

a support member placed in a part of the intermediate layer, the support member being a tubular member having an inner peripheral surface making contact with an outer surface of the inner radiation layer, and an outer peripheral surface making contact with an inner surface of the outer radiation layer.

8. The exhaust structure for the internal combustion engine, according to claim 6, wherein the intermediate layer is a vacuum layer or an atmospheric layer.

9. The exhaust structure for the internal combustion engine, according to claim 6, wherein the inner radiation layer is a ceramic black paint; and the outer radiation layer is a ceramic black paint.

10. An exhaust structure for an internal combustion engine, the exhaust structure comprising:

an exhaust pipe having a double-pipe structure including an inner pipe through which exhaust gas of the internal combustion engine flows, and an outer pipe covering an outer periphery of the inner pipe;

an inner radiation layer provided on an outer surface of the inner pipe and having a higher emissivity of an infrared energy than the inner pipe;

an outer radiation layer provided on an inner surface of the outer pipe and having a higher emissivity of the infrared energy than the outer pipe; and an intermediate layer provided between the inner radiation layer and the outer radiation layer, the intermediate layer configured to pass infrared radiation through the intermediate layer, and the intermediate layer having a lower coefficient of thermal conductivity than the inner pipe and the outer pipe, wherein:

the exhaust pipe is connected, via a flange coupling, to a catalyst placed on an upstream side relative to the exhaust pipe;

a first flange on an exhaust-pipe side is attached to an upstream end of the outer pipe; and a second flange formed in a downstream end of a casing for the catalyst is connected to the first flange; and the catalyst has an extending portion extending into the inner pipe when the catalyst and the exhaust pipe are connected to each other.

11. The exhaust structure for the internal combustion engine, according to claim 10, further comprising:

a support member placed in a part of the intermediate layer, the support member being a tubular member having an inner peripheral surface making contact with an outer surface of the inner radiation layer, and an outer peripheral surface making contact with an inner surface of the outer radiation layer.

12. The exhaust structure for the internal combustion engine, according to claim 10, wherein the intermediate layer is a vacuum layer or an atmospheric layer.

13. The exhaust structure for the internal combustion engine, according to claim 10, wherein the inner radiation layer is a ceramic black paint; and the outer radiation layer is a ceramic black paint.

* * * * *